United States Patent [19]

Golden

[11] 3,967,574

[45] July 6, 1976

[54] MANUALLY CONTROLLED SCULLING MECHANISM

[76] Inventor: William Donald Golden, 6258 Ruthland Road, Oakland, Calif. 94611

[22] Filed: Nov. 14, 1975

[21] Appl. No.: 632,159

[52] U.S. Cl. ..... 115/29

[51] Int. Cl.[2] ..... B63H 1/32

[58] Field of Search ..... 115/21, 24.1–24.6, 115/28 R, 28 A, 29, 30–33

[56] References Cited

UNITED STATES PATENTS

| | | | |
|---|---|---|---|
| 2,979,018 | 4/1961 | Birdsall | 115/29 |
| 3,757,729 | 11/1973 | Golden | 115/29 |

FOREIGN PATENTS OR APPLICATIONS

| | | | |
|---|---|---|---|
| 533,142 | 9/1955 | Italy | 115/28 R |

*Primary Examiner*—Trygve M. Blix
*Assistant Examiner*—Jesus D. Sotelo

[57] ABSTRACT

An apparatus for manually moving and steering a small boat, or the like, in both forward and reverse and all directions, which is mounted on the transom or stern of the boat, having a steering post rotated by a tiller 360° in a horizontal plane, with the tiller mounted for up and down pivotal pumping motion to activate laterally connected blades mounted on the lower end of the steering post, with the blades being horizontally joined for flexible return on the non-power stroke and with no flexing on the power stroke, resembling the action of a duck's foot during swimming, each of said blades having a series of individual windows opening to lessen the resistance or drag on the flexing return or non-power stroke and closing for full resistance on the power stroke.

5 Claims, 5 Drawing Figures

MANUALLY CONTROLLED SCULLING MECHANISM

BACKGROUND OF THE INVENTION

Applicant is the owner of U.S. Pat. No. 3,757,729 issued Sept. 11, 1973. While the device of this patent has worked phenomenally well, it does have limitations which have triggered changes required and perhaps necessary for a fully useful mechanism. For example, in the use of the sculling mechanism of the issued Patent, it has been found that a reverse was necessary in many instances.

Also, it has been found that a more desirable and smoother sculling result could be accomplished with much less effort and therefore quieter, by providing windows in the horizontally connected blades to lessen the drag on the return or non-power stroke, without impairing in any way resistance provided by the blades in the power stroke.

SUMMARY OF THE INVENTION

The present invention is designed to accomplish all of the benefits of the mechanism disclosed and issued in U.S. Pat. No. 3,757,729, and provides the additional benefits indicated and found necessary in the actual use of the earlier mechanism.

In the accomplishment of this, the tiller is mounted for 360° rotation in a horizontal plane. In this manner, the blades can be rotated 180° in either direction, to accomplish the power stroke to propel the boat in a rearward or reverse direction. The tiller which determines the direction of the boat either forward or rearwardly and any degree intermediate thereof, is mounted with a through passage with handles at either end, which act as stops, in order to accomplish rotation of the power blade assembly.

A further accomplishment of the present invention is the elimination of most of the drag on the return stroke whether in the forward or reverse position or any intermediate position. This has been accomplished by providing windows in each of the horizontally connected blades, which permit the passage of the water therethrough on a return stroke, while closing and forming a rigid unified power surface for the power stroke.

Further objects are to provide a construction of maximum simplicity, economy and ease of assembly and disassembly, also such further objects, advantages and capabilities as will fully appear and as are inherently possessed by the device and invention described herein.

The invention further resides in the combination, construction and arrangement of parts illustrated in the accompanying drawings, and while there is shown therein a preferred embodiment thereof, it is to be understood that the same is illustrative of the invention and that the invention is capable of modification and change and comprehends other details of construction without departing from the spirit thereof or the scope of the appended claims.

DESCRIPTION OF PREFERRED EMBODIMENTS

Figure 1:
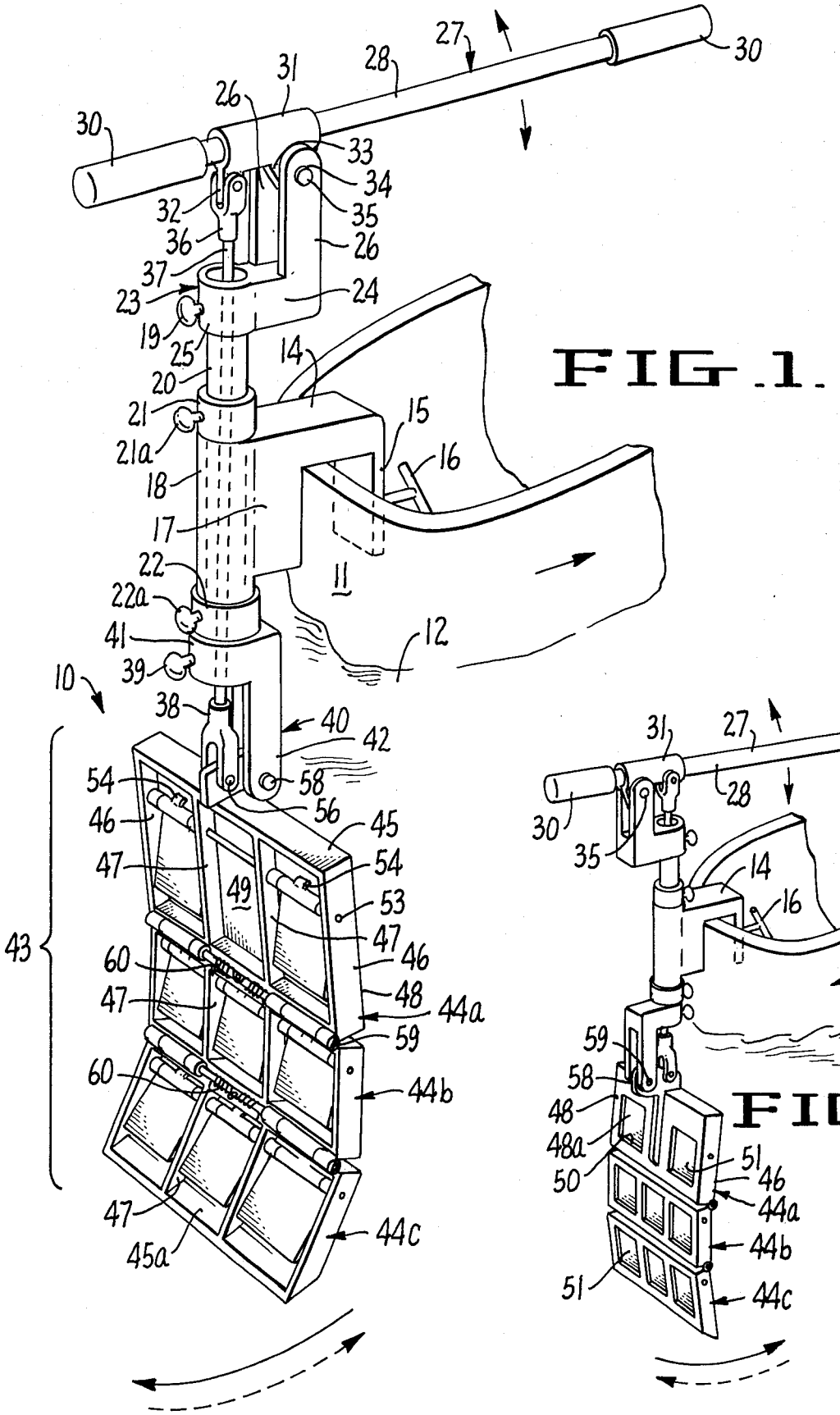
FIG. 1 is a perspective view showing the device of the present invention mounted on the transom at the stern of a small boat, and showing the equipment in the position for forward movement. The direction of the power stroke is indicated by the solid line with arrow, and the direction of the return stroke is indicated by the dotted line with the arrow.

Referring now more particularly to the drawings in which like numerals refer to like parts in the several views, and particularly with reference to FIG. 1, the complete sculling mechanism is indicated at 10. The device is mounted on the transom 11 of a boat 12 at the stern thereof or at an appropriate position on any other object to be propelled. It is mounted thereon with a mounting bracket 14 having a downward extending leg 15 which hooks over the top edge of the transom 11 and engages the inner face of the boat 12. It is secured to the transom 11 by means of clamping screw 16, carried thereon.

The bracket 14 also includes a spacer portion 17 spaced from the downwardly extending leg 15 to accommodate various thicknesses of boat transoms. The spacer block portion 17 has another purpose which will become apparent as this description proceeds.

Preferably bracket 14 includes a mounting means formed integral with the spacer block 17 and is a hollow cylinder 18 vertically disposed, which receives the hollow shaft 20 for axial rotation therewith. The tube 20 is positioned with respect to the cylindrical bracket portion 18 by means of adjustable clamping rings 21 and 22, held in the adjusted position by thumbscrews **21*a* and 22*a*** respectively.

Bracket 23 is adjustably received adjacent the top portion of the cylinder 20. Bracket 23 consists of a horizontal portion 24 having an integral cylindrical collar portion 25 having an axial passage therethrough for adjustably receiving the hollow cylinder 20. The position is maintained on tube 20 for rotation therewith by means of thumbscrew 19 or any other suitable means. Axially offset from the cylindrical portion 25 are two spaced upstanding arms 26.

Figure 2:
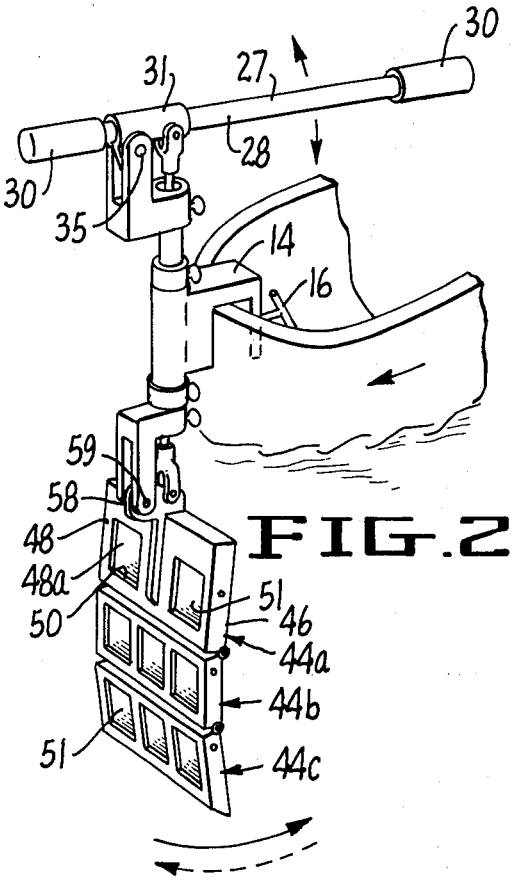
FIG. 2 is a perspective view similar to that shown in FIG. 1 on a smaller scale but with blades rotated 180° for rearward propulsion.
Figure 3:
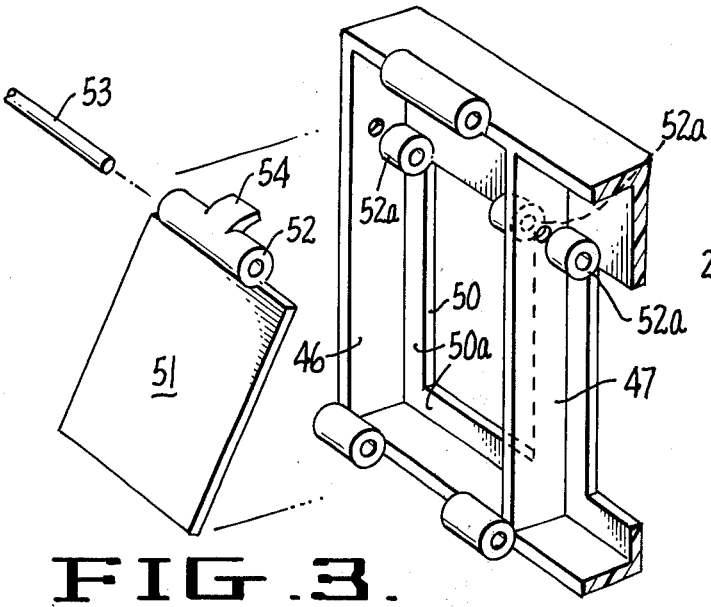
FIG. 3 is an enlarged perspective fragment of a blade showing the window and the mounting of the closure for the window in the proper stroke.
Figure 4:
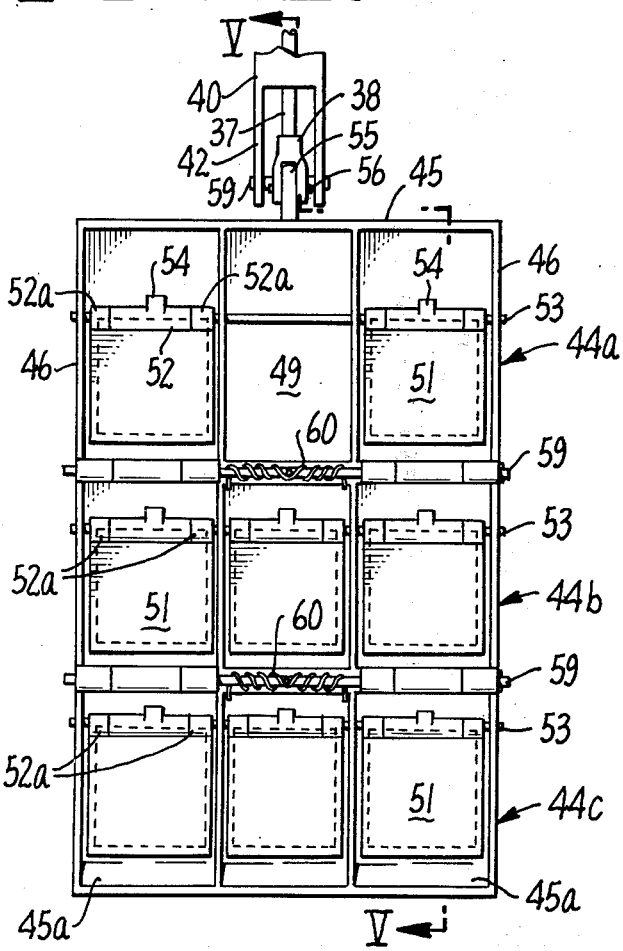
FIG. 4 is a rear elevational view of the attached panels showing the positioning of the windows.

The tiller 27 is made of any suitable material such as metal or wood and has a handle portion 28 of any suitable cross-section. At either end of the handle portion 28 there are two grips 30 or other suitable means which also act as stops, as will be observed. The handle 28 slides axially within a collar 31, as shown in FIGS. 1 and 2. The slide of the tiller handle within collar 31 accomplishes several objectives. One is that the leverage available for pumping action can be adjusted by sliding the same forward or backward within the collar 31. Another is that when the device is rotated 180° the handle can be in position properly for use as shown in FIG. 2 without further adjustment.

The collar number 31 is provided with a radially downwardly extending ear 32 and one or more ears lying at either side and in planes parallel to the ear 32. Ears 33 have holes therein in registration with the holes 34 of the upstanding legs 26 for operatively receiving fulcrum pin 35 and thus permitting the tiller 27 to move upwardly and downwardly in a vertical plane to accomplish the pumping action required for propulsion. Ear 32 receives a clevis 36 attached to the upper end of the rod 37 which runs axially downwardly in a vertical plane through tube 20 and to which a clevis 38 is attached at the lower end.

At the lower end of tube 20 is mounted a member 40 which preferably has an integral collar portion 41 and a downward extending pair of offset arms 42 forming a yoke. The collar portion 41 is provided with a thumbscrew 39 or other suitable means for securing the same in the adjusted position for rotation with the tube 20. It will thus be observed that as the tiller 27 is rotated in a horizontal plane, the hollow tube 20 also rotates because of the collar member 25 which is secured thereto. The spacer adjuster collar 21 also rotates with the tube 20 being secured thereto and bears against the upper surface of the bracket 14. Thus, the tube 20 is rotated within the cylindrical portion of the bracket 14. Spacer collar 22 also being secured to the tube 20 rotates therewith along with the yoke 40. In this manner the entire blade assembly 43 is rotated.

The blade assembly 43 may generally be described as having three or more box-like blade units 44a, 44b and 44c. Unit 44a has top and side walls 45 and 46 respectively, extending at right angles to the surface, along the outer margins, forming a frame. Within this frame are vertical divider members 47. The inner surface 48 of each blade (as viewed in FIG. 1) presents a solid face as the windows 50 are covered by a flap gate plate 51. Windows 50 are cut in the plate or surface 48 to provide openings therethrough, between the dividers 47. However, the area 49 in blade 44a may be omitted to present a solid face to strengthen the attaching mechanism as will be described later. These openings 50 are closed by flap gates 51 which have a lateral through passage 52 along the top edge thereof for receiving a rod 53. In the manner of a conventional hinge, the rod 53 also passes through fixed passages 52*a*. The flap gates 51 are larger than the window opening 50 and bear against flanges 50*a* to make certain to stop the flow of water through the windows on the power stroke. The rod 53 is journalled in walls 46 at either side, and the flap gates 51 are free to swing on the rod 53 away from the windows 50 on the return stroke. However, each flap gate 51 is provided with a stop member 54 on passage 52 which limits the amount of open swing available. The stop 54 allows sufficient flow to lessen resistance on the return stroke but prevents the gate from remaining in the open position when the assembly is returned for the power stroke.

The top 45 of the frame member has an upwardly extending vane 55 with a lateral hole therethrough for receiving a pin 56 which secures the clevice 38 to the blade assembly. The vane 55 has an outwardly extending ear portion 58 having a hole therethrough to receive pin 59 which also connects the blade assembly to the bracket 40. The vertical movement of the rod 37 transmits motion to the blade in an arc against the fulcrum of pin 59. It is apparent that reasonable adjustment of the stroke of the arc can be made by varying the distance between pins 56 and 58, and the degree of offset.

Figure 5:
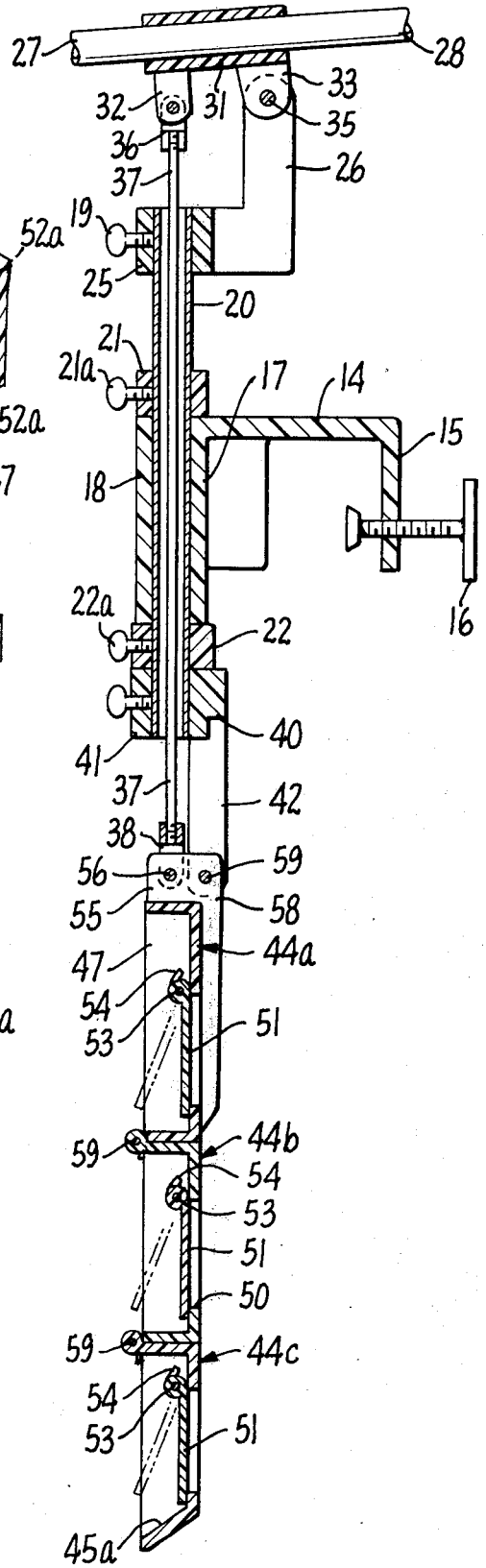
FIG. 5 is a vertical section of the mechanism of FIG. 1 taken on the line V — V of FIG. 4.

Blades 44*a* and 44*b*, 44*b* and 44*c* are hingedly mounted together for hinging movement in one direction only. The hinging is conventional. The mounting is along the wall edge opposite to the solid face 48 of the blade, and while the blades 44*b* and 44*c* are allowed to flex or hinge in one direction on the pintles or rods 59 as noted, they are mounted with tension springs 60 which are biased to return the blades to their abutting vertical position as shown in FIG. 5. The blades 44*a*, 44*b* and 44*c* are virtually identical with the exception that a center window in blade 44*a* is not cut, while the lower frame member 45*a* of blade 44*c* is slanted outwardly to form a scoop.

It will be observed that the yoke 42 is secured in an offset position from the clevice 38 on the vane wall 40 of blade 44a so that the blade assembly 43 is rotated in a horizontal plane around the axis of the tube 20 by movement of the tiller 27. Also, the blades 44*a*, 44*b* and 44*c* are made subject to the movement of the tiller in a pumping action in a vertical plane by the movement of the rod 37 in an up and down manner. This movement of the blade assembly 43 is in an arc with respect to the fulcrum pin 58.

It is to be understood that there is sufficient length of the rod 37 to accomplish the accurate movement and that it requires only a slight pumping action with the handle 28 to move the blade assembly 43 from the power position through the power stroke and return it in the return stroke.

OPERATION

As indicated earlier, the device 10 is secured to the transom or other portion of a boat or the like, by means of the hooked clamping bracket 14. It is tightened in position by the thumbscrew 16 or other suitable means. In the mounting of the sculling device, the blades normally assume the vertical position by gravity, as shown in FIG. 5, with all of the blades substantially in the same vertical plane and the blades 44*a*, 44*b* and 44*c* in abutting position with the windows 50 closed by flap gates 51. This is the normal neutral position. The position of tube 20 may be adjusted, raised or lowered as required, along bracket 14 in order to regulate the depth of the blades below the surface of the water. This is accomplished by means of collars 21 and 22. The mounting of the device should take the position of the tiller 27 being in position in a horizontal plane along the longitudinal axis of the boat, or other floating means, or in a plane parallel thereto.

In order to scull the boat, the tiller arm 27 is lowered to approximately 45°. This action on the fulcrum pin 35 raises rod 37 in tube 20 and causes the blade assembly 40 to move into the power stroke direction with all of the blade abutting in the same plane, with the flap gates 51 closed against the window openings 50, aided by the bias of springs, presenting a solid unbendable surface for contact with the water. The pressure of the water against the blades provides the power for the forward thrust motion (See FIG. 5). The rectangular boxes on the power side of each blade keeps the water from moving laterally to lessen the power of the stroke. When the tiller arm is raised in a vertical plane after the power stroke, this is the return stroke, or non-power stroke. During the course of the return stroke, the water pressure against the flap gates 51 on the blades are free to swing open and permit the water to pass through, subject only to the stops 54. This same return stroke permits the water pressure against the returning face to cause the blades 44*b* and 44*c* to hinge on the pintles or rods 59. Thus, two factors are at work in lessening the resistance of the blade assembly on the return or non-power stroke. In this manner, it will be seen that the movement of the blades resembles what occurs in nature in the webbing of a duck's foot which is opened and solid when making the power stroke for forward propulsion and is folded together to reduce resistance in making the return for the next power stroke. As has been stated, it is the downward stroke of the tiller which causes the sculling device to propel the boat forward and the upward movement of the tiller 27 which causes the return stroke.

For reversing the direction of propulsion, the tiller arm 27 is moved 180° in a horizontal plane which in turn rotates the blade assembly 43 180° mounted on the bracket assembly 40. The tiller arm 27 is merely slid through the collar 31 so that the pumping fulcrum pin 35 still receives the leverage required to make the pumping strokes, as used in forward propulsion. With this rotation, the downward movement causes the blade assembly 43 to move toward the boat, propelling the boat in reverse. The blade assembly 43 behaves in the same manner as described above for forward propulsion. The upper movement of the tiller arm moves the blade assembly rearwardly of the boat and performs the same non-resistent functions as described for the forward direction.

Steering is easily accomplished by the rotation of the tiller arm 27 in a transverse direction during the pumping action or between strokes without impeding the pumping action either in the forward or in reverse direction. While speed is usually not required, it may obviously be attained by increasing the tempo of the pumping action.

It will be observed that the spacer portion 17 of the bracket 14 provides the necessary separation of the boat from the bracket to accomplish the rotation of the sculling mechanism 360° without in any way interfering with the operation of the screw clamps and collars, or binding in any way.

Should any of the parts of the sculling mechanism 10 be damaged, they may be repaired or replaced easily. The blades 44*a*, 44*b* and 44*c* may be more subject to damage than any other parts and these may be replaced instantly by removal of the pintle 59, replacing the damaged blade or blades, and resetting the pintle 59 and spring 60.

It will be seen that all the objectives of the present invention are obtained in this particular construction and that this mechanism not only is capable of performing movement in a forward or reverse manner, but in all of the increments in between, by merely the operation of the tiller arm 27. There is no possibility of fishtailing by the use of this mechanism and the operation is completely silent regardless of the direction of movement. All the telltale results of oars or paddles are eliminated regardless of the place or the shallowness of the operation.

I claim:

1. Apparatus for manually propelling and steering a water craft comprising in combination, a steering post rotatable 360° axially in a horizontal plane, a tiller for rotating said steering post and mounted thereon for pivotal movement up and down to provide a pumping stroke, a plurality of blades mounted on the lower end of said steering post at right angles to the vertical plane of said tiller and for movement with said steering post, said blades being hinged together horizontally for flexing in one direction only which direction is the return stroke, means on said blades for preventing flexing in the other direction which is the power stroke, said blades also having a plurality of windows therethrough and hinged cover plates for covering and closing said windows on the power stroke and opening on the return stroke, linkage means connecting said blades to said tiller to move said blades alternately rearward on the power stroke and forward on the return stroke for propelling said craft forwardly.

2. The apparatus of claim 1 wherein there is a bracket means secured to said steering post for detachable and adjustable mounting the apparatus on a water craft, said bracket having a screw to releasably secure the apparatus and adjustable collars for adjusting the depth of the apparatus.

3. The apparatus of claim 1 in which the steering post is tubular and the tiller is mounted wih a bracket at the top of said steering post for axial rotation thereof to provide steering, while also mounted for pivotal movement in a vertical plane to provide a pumping action, said linkage connecting the tiller with the vanes passing through the tubular steering post.

4. Apparatus for manually propelling and steering a water craft comprising in combination, a bracket for removably securing the apparatus to a water craft, a vertical hollow steering post rotatably mounted on said bracket and spaced from the point of attachment of said bracket to provide clearance and free movement in 360°, a tiller for steering said craft pivotally mounted at the top end of said steering post for axially rotating said steering post a full 360°, a mounting for said tiller, a multiplicity of transverse blades fixedly mounted at the lower end of said steering post for rotary movement therewith, said blades being hinged transversely together for flexing in one direction with stops to prevent flexing in the opposite direction, combined so as to present a substantially solid surface, said blades also having windows cut therethrough, with hinged covers for said windows opening to allow passage of fluid therethrough upon flexing of the blades and closing upon movement in the opposite direction, said pivotal mounting of said tiller providing vertical pumping action with said tiller, regardless of the rotated position, and linkage connecting said tiller mounting with said vanes for moving them alternately in one direction and then in the opposite direction.

5. The apparatus of claim 4 wherein the mounting for said tiller provides slideable positioning of said tiller for operation in the usual manner when the steering post is rotated more than 90° in either horizontal direction for reverse movement.

* * * * *